US009114925B2

(12) United States Patent
Weissbrod

(10) Patent No.: US 9,114,925 B2
(45) Date of Patent: Aug. 25, 2015

(54) CONTAINER FOR ELONGATED ARTICLES

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 303 days.

(21) Appl. No.: 13/230,896

(22) Filed: Sep. 13, 2011

(65) Prior Publication Data

US 2013/0062229 A1 Mar. 14, 2013

(51) Int. Cl.
*B65D 85/20* (2006.01)
*B65D 85/26* (2006.01)
*B65D 25/10* (2006.01)

(52) U.S. Cl.
CPC ..... *B65D 85/26* (2013.01); *B65D 25/103* (2013.01)

(58) Field of Classification Search
CPC ..... B65D 75/366; B65D 83/02; B65D 2575/368; B65D 2575/365; B65D 85/26; B65D 85/103
USPC ..... 206/443, 461–471, 570, 557–561, 223
See application file for complete search history.

(56) References Cited

U.S. PATENT DOCUMENTS

| | | | |
|---|---|---|---|
| 179,035 | A | 6/1876 | Leland |
| 1,320,757 | A | 11/1919 | Hothersall |
| 1,432,968 | A | 10/1922 | Conley |
| 2,114,052 | A | 4/1938 | Kincade, Jr. |
| 2,759,656 | A | 8/1956 | Abrams |
| 2,878,128 | A | 3/1959 | Jorgenson |
| 3,151,800 | A | 10/1964 | Griese, Jr. |
| 3,207,415 | A | 9/1965 | Schechter |
| 3,391,847 | A | 7/1968 | Christine et al. |
| 3,441,165 | A | 4/1969 | Zampichelli |
| 3,488,201 | A | 1/1970 | Pizarro |
| 3,690,504 | A | 9/1972 | Ragettli |
| 3,783,071 | A | 1/1974 | Monks |
| 3,799,389 | A | 3/1974 | Bloeck |

(Continued)

FOREIGN PATENT DOCUMENTS

| | | |
|---|---|---|
| CN | 2706406 | 6/2005 |
| DE | 7923976 U1 | 11/1979 |

(Continued)

OTHER PUBLICATIONS

International Search Report for PCT/IB2012/001764 dated Apr. 4, 2013.

(Continued)

*Primary Examiner* — Mickey Yu
*Assistant Examiner* — Chun Cheung
(74) *Attorney, Agent, or Firm* — Hahn, Loeser & Parks, LLP

(57) ABSTRACT

A container is provided for holding a predetermined mass of associated elongated cylindrical articles within a cavity. The container includes a bottom wall having a perimeter, a pair of spaced apart side walls extending upwardly from perimeter of the bottom wall, and a pair of spaced apart end walls extending upwardly from the perimeter of the bottom wall between the sidewalls. The container also includes at least one first step extending a height upward from the bottom wall and having a variable length, and at least one second step extending a height upward from the bottom wall and having an approximately fixed length less than the width of the container between the sidewalls.

20 Claims, 12 Drawing Sheets

(56) References Cited

U.S. PATENT DOCUMENTS

| | | | | | |
|---|---|---|---|---|---|
| 3,829,003 | A | * | 8/1974 | Dilot | 229/120.38 |
| 3,866,820 | A | | 2/1975 | Zumsteg et al. | |
| 3,890,448 | A | | 6/1975 | Ito et al. | |
| 3,892,058 | A | | 7/1975 | Komatsu et al. | |
| 3,946,871 | A | | 3/1976 | Sturm | |
| 3,946,872 | A | | 3/1976 | Sturm | |
| 4,005,776 | A | * | 2/1977 | Seeley | 206/306 |
| 4,094,460 | A | | 6/1978 | Scanga et al. | |
| 4,266,669 | A | * | 5/1981 | Watson | 206/564 |
| 4,338,378 | A | | 7/1982 | Nabeta et al. | |
| 4,474,727 | A | | 10/1984 | Kmonk et al. | |
| 4,645,079 | A | * | 2/1987 | Hill | 206/563 |
| 4,801,041 | A | | 1/1989 | Takata et al. | |
| 4,915,289 | A | | 4/1990 | Hatano et al. | |
| 4,917,245 | A | * | 4/1990 | Wu | 206/471 |
| 5,022,551 | A | | 6/1991 | Hexel | |
| 5,098,751 | A | | 3/1992 | Tamura et al. | |
| 5,100,021 | A | * | 3/1992 | Mussi et al. | 221/155 |
| 5,116,651 | A | | 5/1992 | Katsura et al. | |
| 5,167,339 | A | | 12/1992 | Takata et al. | |
| 5,176,258 | A | * | 1/1993 | Antal | 206/461 |
| 5,178,293 | A | | 1/1993 | Suzuki et al. | |
| 5,379,895 | A | * | 1/1995 | Foslien | 206/363 |
| 5,613,617 | A | | 3/1997 | Da Vitoria Lobo | |
| 5,634,567 | A | | 6/1997 | Hekal | |
| 5,755,326 | A | | 5/1998 | O'Neill | |
| 5,873,218 | A | | 2/1999 | Kendig | |
| 6,302,271 | B1 | | 10/2001 | Grant | |
| 6,896,141 | B2 | * | 5/2005 | McMichael et al. | 206/571 |
| 7,854,323 | B2 | | 12/2010 | Weissbrod | |
| 8,083,058 | B2 | * | 12/2011 | Marcinkowski et al. | 206/352 |
| 2005/0145630 | A1 | | 7/2005 | Williams et al. | |
| 2005/0252918 | A1 | | 11/2005 | McKnight et al. | |
| 2008/0202976 | A1 | * | 8/2008 | Burgess et al. | 206/558 |
| 2009/0021937 | A1 | | 1/2009 | Sloan et al. | |
| 2010/0018882 | A1 | | 1/2010 | St. Charles | |
| 2010/0018883 | A1 | | 1/2010 | Patel | |
| 2010/0251672 | A1 | | 10/2010 | Weissbrod | |
| 2010/0307942 | A1 | * | 12/2010 | Tomes et al. | 206/370 |

FOREIGN PATENT DOCUMENTS

| | | | |
|---|---|---|---|
| EP | 0169154 | A1 | 1/1986 |
| EP | 0362020 | A1 | 4/1990 |
| EP | 1801024 | A2 | 6/2007 |
| EP | 1938951 | A2 | 7/2008 |
| GB | 1082083 | | 9/1967 |
| GB | 1110674 | | 4/1968 |
| GB | 1179295 | | 1/1970 |
| JP | 2002179144 | | 6/2002 |
| WO | 2008/095262 | A1 | 8/2008 |

OTHER PUBLICATIONS

Written Opinion of the ISA for PCT/IB2012/001764 dated Apr. 4, 2013.

* cited by examiner

CONTAINER FOR ELONGATED ARTICLES

FIELD OF INVENTION

The present invention relates generally to packaging and methods for the shipping of elongated articles, and more particularly to containers for holding welding wire electrodes.

BACKGROUND

Over the past decades, welding has become a dominant process in fabricating industrial and commercial products. Applications for welding are wide-spread and used throughout the world. Examples include the construction of ships, buildings, vehicles and pipe lines. Welding is also used in repairing or modifying existing products. Among the various methods of joining metal components, arc welding is one well known and very common process.

The arc welding process may employ consumable welding wire, which in some instances may be provided in the form of stick electrodes, otherwise known as welding rods. While such containers have provided sufficient protection during bulk shipment of stick electrodes to distributors, the market for direct-to-consumer sales requires additional safeguards for shipping and storage. In some instances, the stick electrodes may be covered with a flux coating, which in some instances may be brittle and/or hygroscopic. As such, the coating may be damaged or otherwise compromised during the shipping and/or storage process prior to welding by excessive motion, exposure to the ambient environment, and other deleterious conditions. Accordingly, what is needed is a container for elongated articles, such as welding electrodes, which provides protection to the articles from both movement and other environmental conditions encountered during shipping and storage.

SUMMARY OF THE INVENTION

In one embodiment, there is provided is a container for holding a predetermined mass of associated elongated cylindrical articles within a cavity. The container comprises a bottom wall having a perimeter, a pair of spaced apart side walls extending upwardly from the perimeter of the bottom wall, and a pair of spaced apart end walls extending upwardly from the perimeter of the bottom wall between the sidewalls. Additionally, the container comprises at least one first step extending a height upward from the bottom wall and having a length equal to the width of the container between the sidewalls and at least one second step extending a height upward from the first steps and having a length less than the width of the container between the sidewalls and less than the length of the first steps.

DETAILED DESCRIPTION OF THE INVENTION

Figure 1:
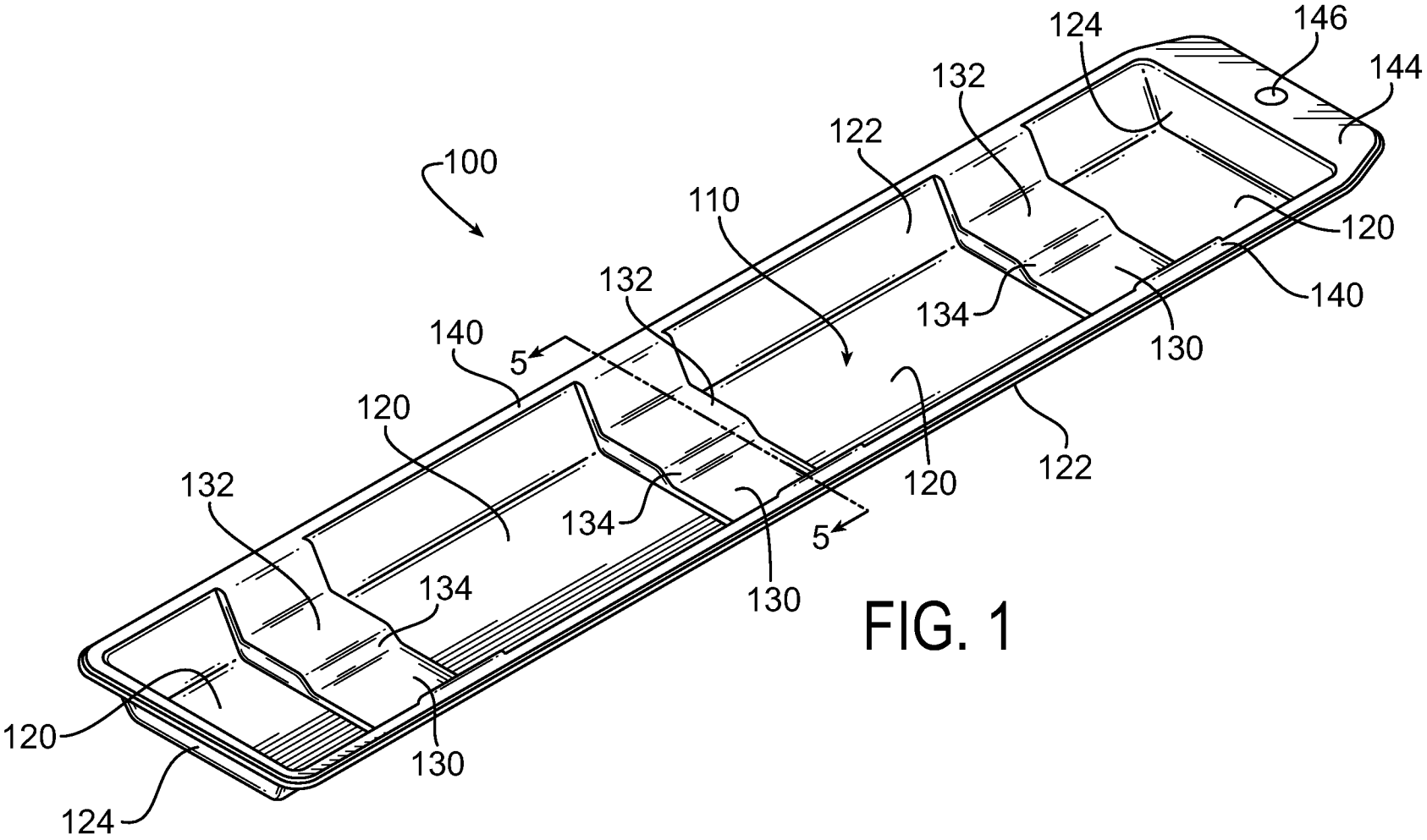
FIG. 1 is a perspective view of one embodiment of a container for elongated articles.
Figure 2:
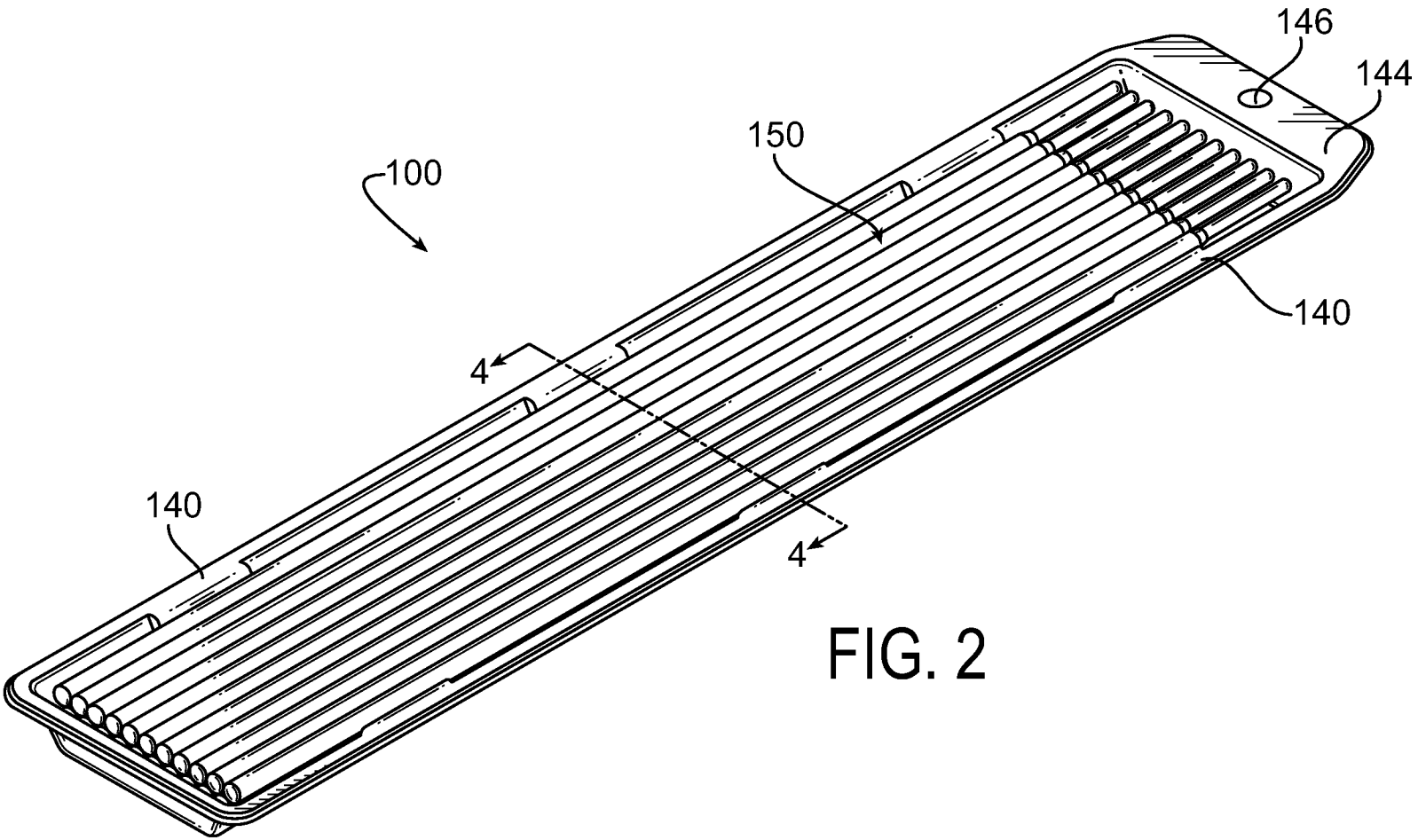
FIG. 2 is a perspective view of the container in FIG. 1 with associated elongated articles held therein.
Figure 3:
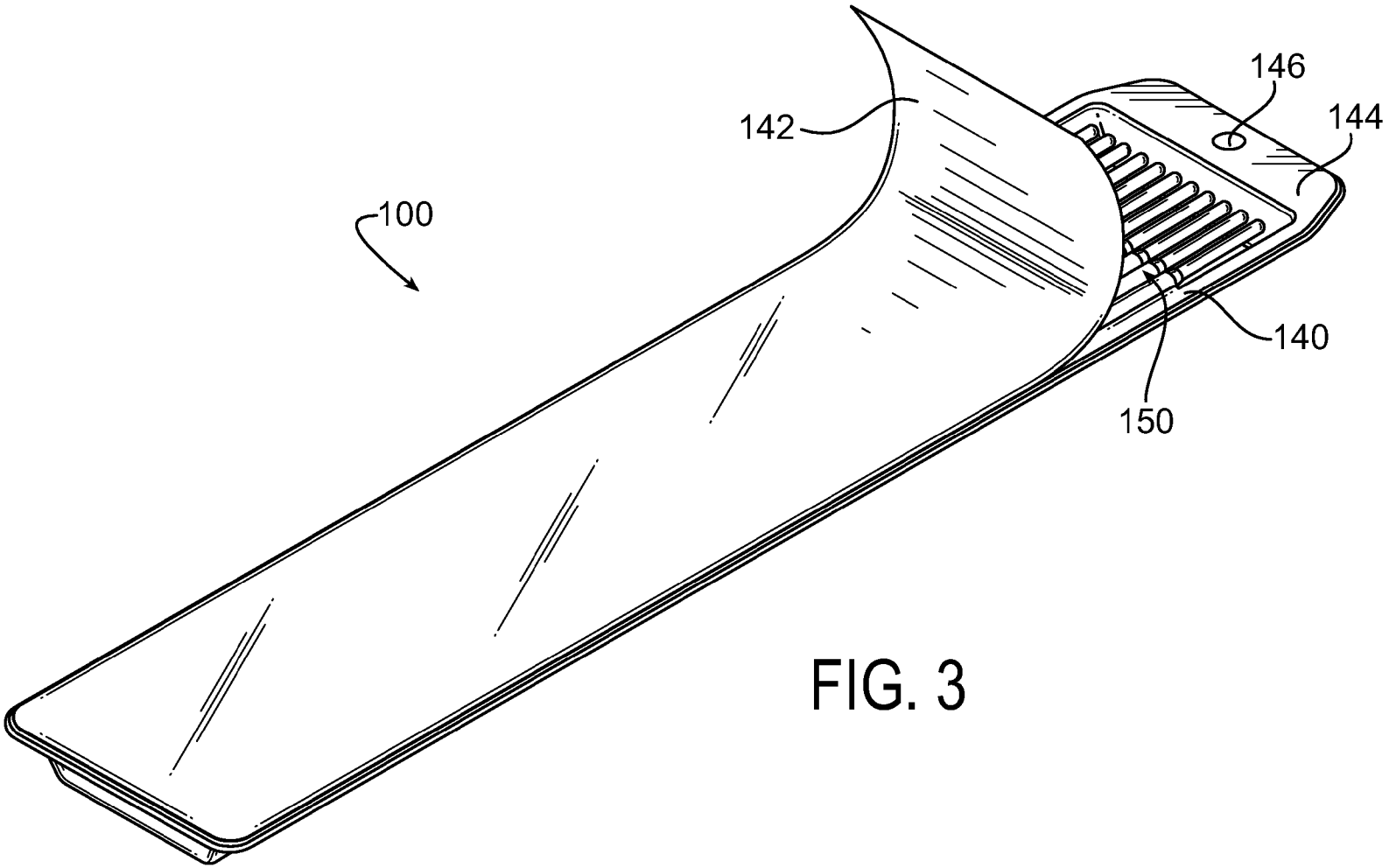
FIG. 3 is a further perspective view of the container in FIG. 1 with associated elongated articles held therein with a flexible cover affixed about a portion of the container flange.

Referring now to the drawings wherein the showings are for purposes of illustrating embodiments of the disclosed subject matter only and not for purposes of limiting the same, FIGS. 1-5 show one embodiment of a container 100 utilized for storage and transport of associated elongated cylindrical articles 150, such as welding electrodes. In one embodiment, the container 100 comprises a bottom wall 120, a pair of spaced apart side walls 122, and a pair of spaced apart end walls 124. The distance between the spaced apart end walls 124 is substantially the same as the length of each of the elongated articles 150. The container 100 also includes at least one first step 130 and at least one second step 132. As shown in the FIGS., the at least one first step 130 and the at least one second step 132 may include two or more spaced apart steps 130, 132, which may be parallel spaced. In construction, the container 100 may be provided as an uncoated metal, e.g. aluminum, tray or as a tin tray at least partially coated with a lacquered film, although other materials, such as reinforced plastic, may also be used in forming the container. Prior to filling the container 100 with a predetermined mass of the associate articles 150, the container body may not be provided with either first steps 130 or second steps 132 formed therein. Rather, the container body may be provided as a non-formed blank, which may be subsequently pressed or stamped to include steps 130, 132 of varying dimension depending on the size of associated articles 150 to be packaged therein.

Still referring to FIGS. 1-5, the bottom wall 120 has a perimeter. In one embodiment, the perimeter is polygonal and has a width and a length. As shown, the spaced apart side walls 122 extend upwardly from the perimeter of the container bottom wall 120 and are perpendicular to the spaced apart end walls 124, which also extend upwardly from the bottom wall 120. Given the configuration of the walls 120 122, and 124, it can be said that the walls define the volume of the container 100, which for purposes of this disclosure will be referred to as a cavity 110. A flange 140 defines the upper perimeter of the container at the top of walls 122, 124.

Figure 4:
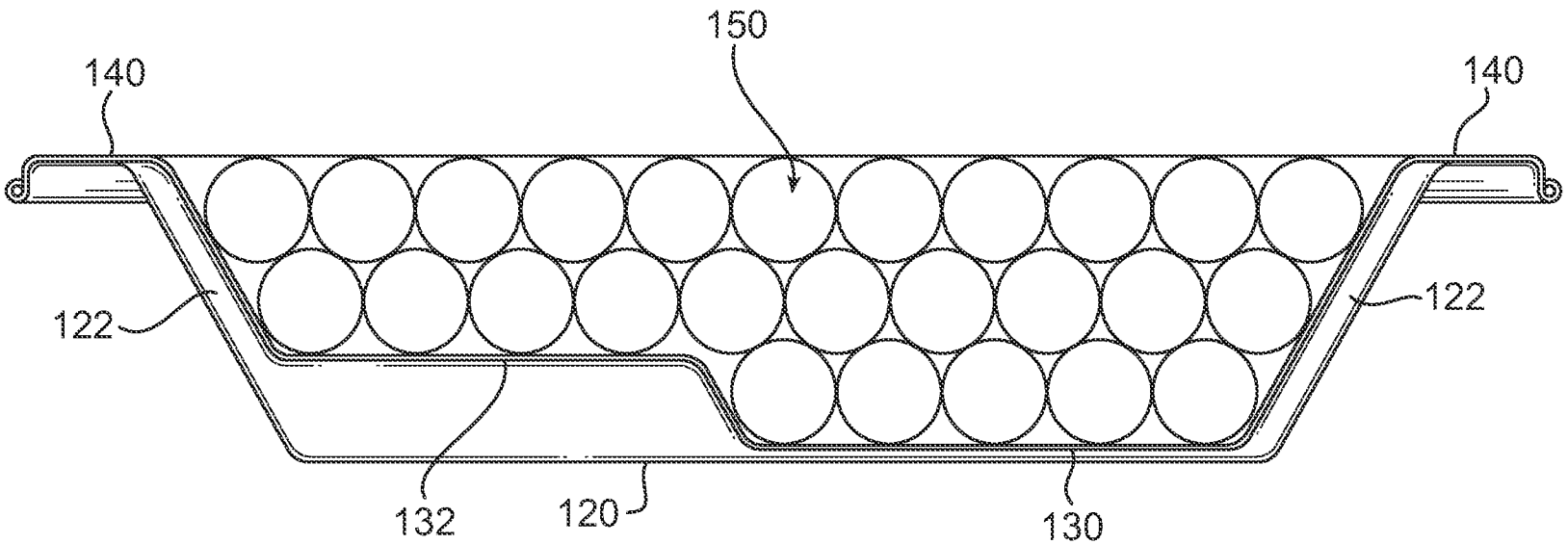
FIG. 4 is sectional view of the container and associated elongated articles shown in FIG. 2 taken along line 4-4.

In construction, the side walls 122 slope outwardly from the bottom wall 120 and away from each other at a preselected angle $\alpha$. In other words, the side walls 122 are angled away from vertical by half of angle $\alpha$. In one embodiment, the angle $\alpha$ is about 60° in order to obtain a dense arrangement of the elongated articles 150. Utilizing the angle $\alpha$ of 60° results in a hexagonal arrangement of circles in a plane, as best shown in FIG. 4. Given that a hexagonal configuration results in the highest density of packing circles, such an arrangement of the side walls 122 permits packaging of a relatively large number of elongated articles 150 in a cavity 110 having a relatively small volume, thereby decreasing the amount of material used for packaging, thereby increasing the amount product contained within a given volume of sales space. Alternatively, it is contemplated that the angle $\alpha$ may be predetermined to be within a range of angles, for example between about 55° and about 65°, although both larger and smaller ranges of angles are also contemplated, albeit, with less efficiency from a packing density perspective.

Returning to FIGS. 1 and 5, the container 100 also includes a plurality of first steps 130 which extend a height $H_1$ upward from the bottom wall 120. The first steps 130 have a variable length which is equal to the width of the container bottom between one side wall 122 and angled wall 134. Given that the walls 122, 134 angle, or slope, away from each other, it should be understood that the length of the first steps 130 varies from a relatively shorter length $L_1$ nearer the bottom of the container 100 to a relatively longer length $L_2$ nearer the flange 140, moving upward from the bottom wall 120 as the distance between the walls 122, 124 increases. As best shown in FIG. 1, the first steps 130 may be three steps. The first steps 130 may be spaced or arranged equidistantly along the length of the container 100, although other, asymmetrical arrangements of the steps are also contemplated.

Figure 5:
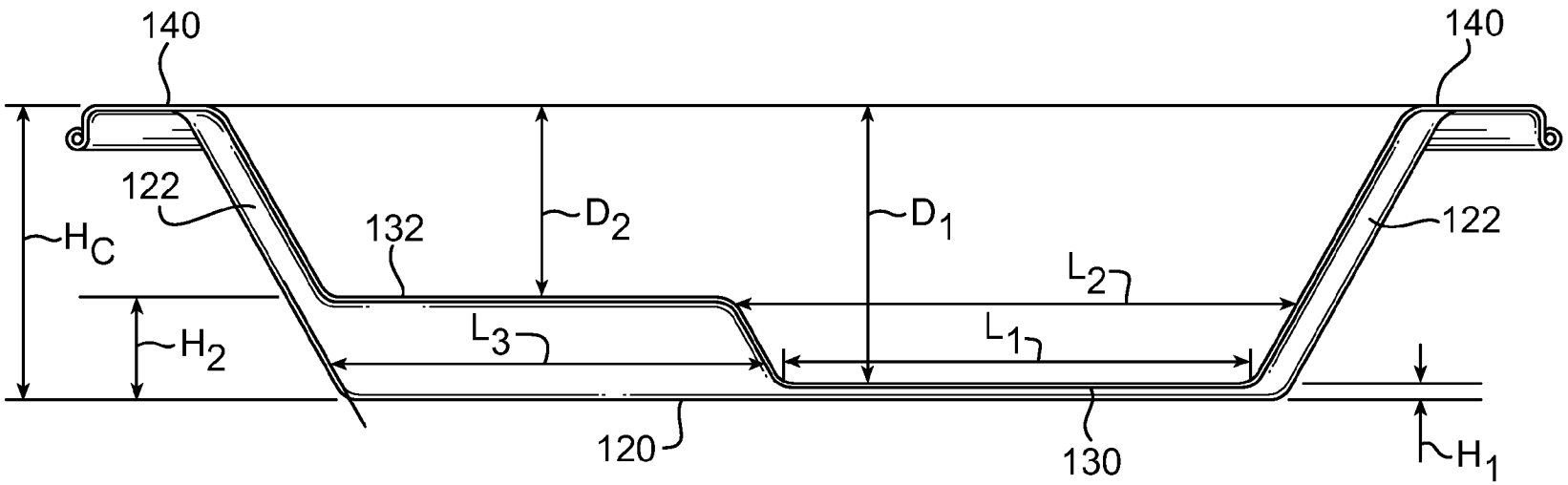
FIG. 5 is further sectional view of the container in FIG. 1 taken along line 5-5.

In addition to the first steps 130, the container also includes at least one, preferably two or more, second steps 132. As illustrated in FIG. 5, the second steps 132 are extend a height $H_2$ upward from the bottom wall 120. Unlike the first steps 130, the second steps 132 have a substantially fixed length $L_3$ which is distance between one of the side walls 122 and the second step angled wall 134 parallel to the side wall. That is, the length $L_3$ is approximately fixed, which is in contrast to the variable length of the first steps 130. In combination, then, the steps 130, 132 may be referred to as means for positioning the articles within the container 100. In one embodiment, at least one of each of the steps 130, 132 may extend directly from at least of the end walls 124. Although the steps 130, 132 are stamped or pressed into the container 100, it is also envisioned that an insert configured to have the same dimensions as the steps may be inserted into an unstamped container prior to filling with electrodes 150. In another embodiment, it is also envisioned that the container 100 may be molded from a plastic material.

As shown in FIGS. 4 and 5, the container cavity 110 has a first depth $D_1$, which corresponds to the height of the container $H_c$ minus the first step height $H_1$. Similarly, the container cavity 110 has a second depth $D_2$, which corresponds to the height of the container $H_c$ minus the height of the second step $H_2$. In the embodiment shown in FIGS. 1-5, the first depth $D_1$ is about 5.5 times the radius of one of the elongated articles 150, which corresponds to the height of three hexagonally packed rows of the elongated articles and results in the upper surface of the top row of elongated articles being flush or level with the flange 140. More specifically, the first depth $D_1$ is 5.46 times the radius of one of the elongated articles 150. Given the angled arrangement of the side walls 122, the height of the second step $H_2$ minus the height of the first step $H_1$ is less than twice the radius of one of the elongated articles. Similarly, the container cavity 110 has a second depth $D_2$, which corresponds to the height of the container $H_c$ minus the height of the second step $H_2$.

In one embodiment, the elongated articles 150 to be packaged in the container 100 are flux-coated welding electrodes. As the manufacturing processes for creation of such electrodes provide a relatively consistent product, each specific electrode diameter-length-flux coating combination has a known bulk density. Accordingly, in the case where a desire exists to sell a predetermined, fixed mass of electrodes (as opposed to a fixed number of electrodes), the container 100 is designed to have a cavity 110 configured to accommodate a volume of electrodes substantially equal to the predetermined mass of electrodes divided by the product of about 0.9 times the bulk density of the electrodes. More specifically, the cavity volume 110 may be configured to accommodate a volume of electrodes substantially equal to the predetermined mass of electrodes divided by the product of about 0.9069 times the bulk density of the electrodes, given that the density of a hexagonal lattice in two dimensional space is found by dividing $\pi$ by the square root of 12, which is approximately to 0.9069. Thus, the filled volume of the cavity 110, or the volume of the cavity actually occupied by electrodes, is the predetermined mass of electrodes divided by the product of about 0.9069 times the bulk density of the electrodes. In one case, the predetermined mass of electrodes may be one kilogram, although a container 100 may be configured to hold other predetermined masses as well.

As the upper surface of the top row of elongated articles 150 is flush or level with the flange 140, a cover 142 is then sealed to the flange 140 and may be sealed to all or a portion of a tab 144. The cover 142 may be formed from a metal foil or laminate metal foil, although other materials, including plastics, may also be employed alone or in combination with the metal foil. Regardless, the cover 142 may be configured to hermetically seal the elongated articles 150 within the container 100 so as to prevent moisture transmission from the ambient environment to the elongated articles. For purposes of this application, a hermetical seal is defined to mean a seal which is airtight, that is, the ambient air does move through the seal. In one case, a vacuum may be drawn in the cavity 110 prior to or contemporaneously with the application of sealing the cover 142 to the flange 140, resulting in vacuum-packaged elongated articles 150. To further prevent the deleterious effects of the ambient environment from entering the sealed container 100, the seal may be chosen to be a material that has extremely low moisture transmissivity, and in certain cases, may have approximately zero moisture transmissivity. As a welder may not use all of the electrodes 150 provided in a container 100 during a single event, a portion of the cover 142 may be selectively resealable to the flange 140. Such an arrangement may permit the welder to peel a portion of the cover 142 from the flange 140, remove one or more electrodes 150, then press the cover back onto the flange, resealing the cover to the flange. To facilitate only partial removal of the cover 142 from the flange 140, it is contemplated that one portion of the cover may be sealed to the flange using a first adhesive, while the portion of the cover configured to be resealable to the flange may be sealed to the flange using a second adhesive, which may be described as a reusable, pressure-sensitive adhesive. Nevertheless, any number and combinations of adhesives or other fasteners may be used to secure the cover 142 to the flange 140.

Optional elongated tab 144 extends away from the container 100 from one of the end walls 124. In one embodiment, the tab 144 may extend directly from the flange 140, although it is also envisioned that the tab may extend directly from an end wall 124 or from a side wall 122. Additionally, an aperture 146 may be formed in the tab 144. In use, the aperture 146 may be passed over a hook or other hanging element for display in a retail environment. Further, a welder may employ the aperture 146 to attach or connect the container 100 to his belt or other place on his person to make access to welding electrodes relatively more convenient as compared to continually returning to a large can or other remote location for additional electrodes during the welding process.

Figure 6:
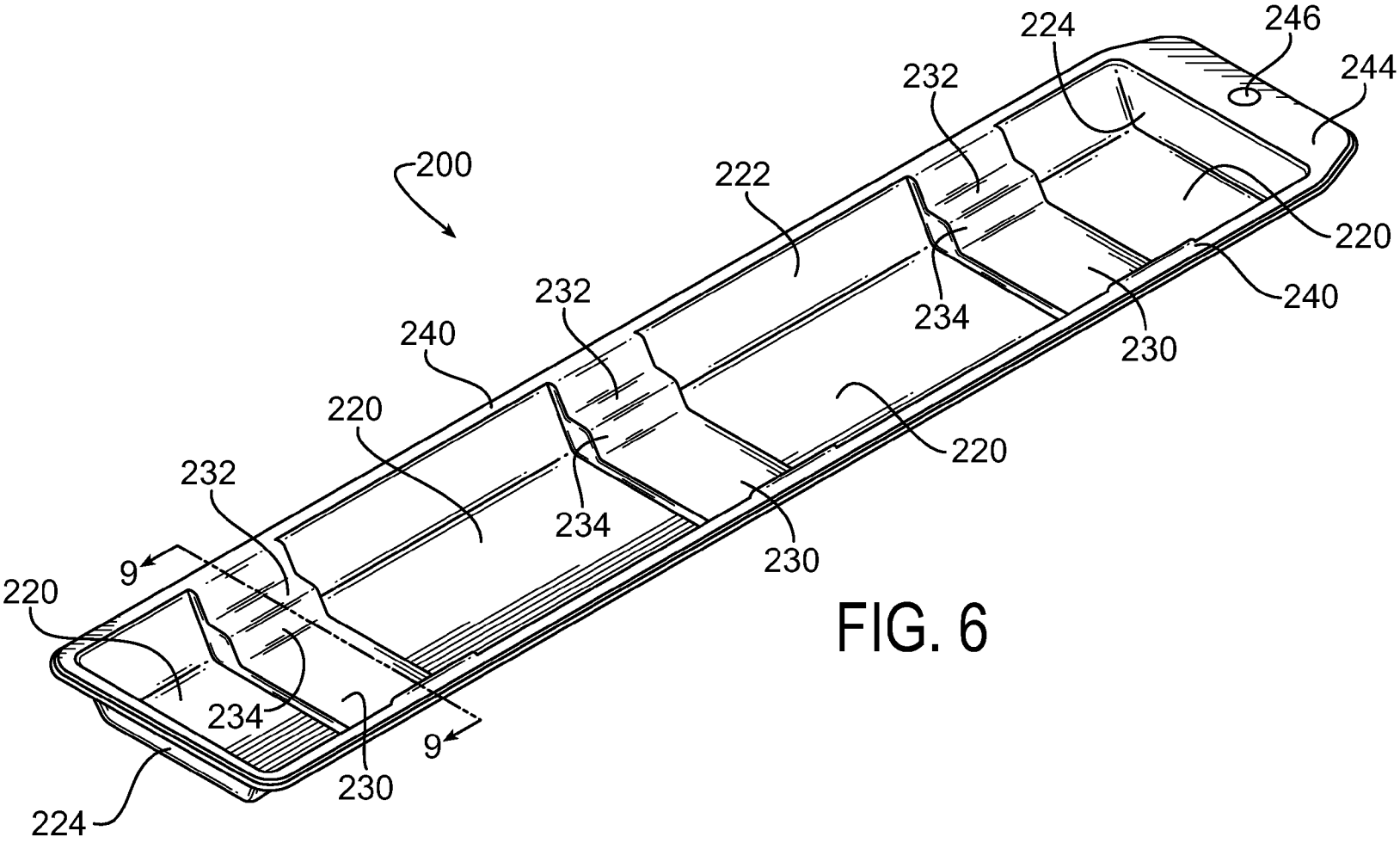
FIG. 6 is a perspective view of another embodiment of a container for elongated articles illustrating a different series of steps as compared to FIG. 2.
Figure 7:
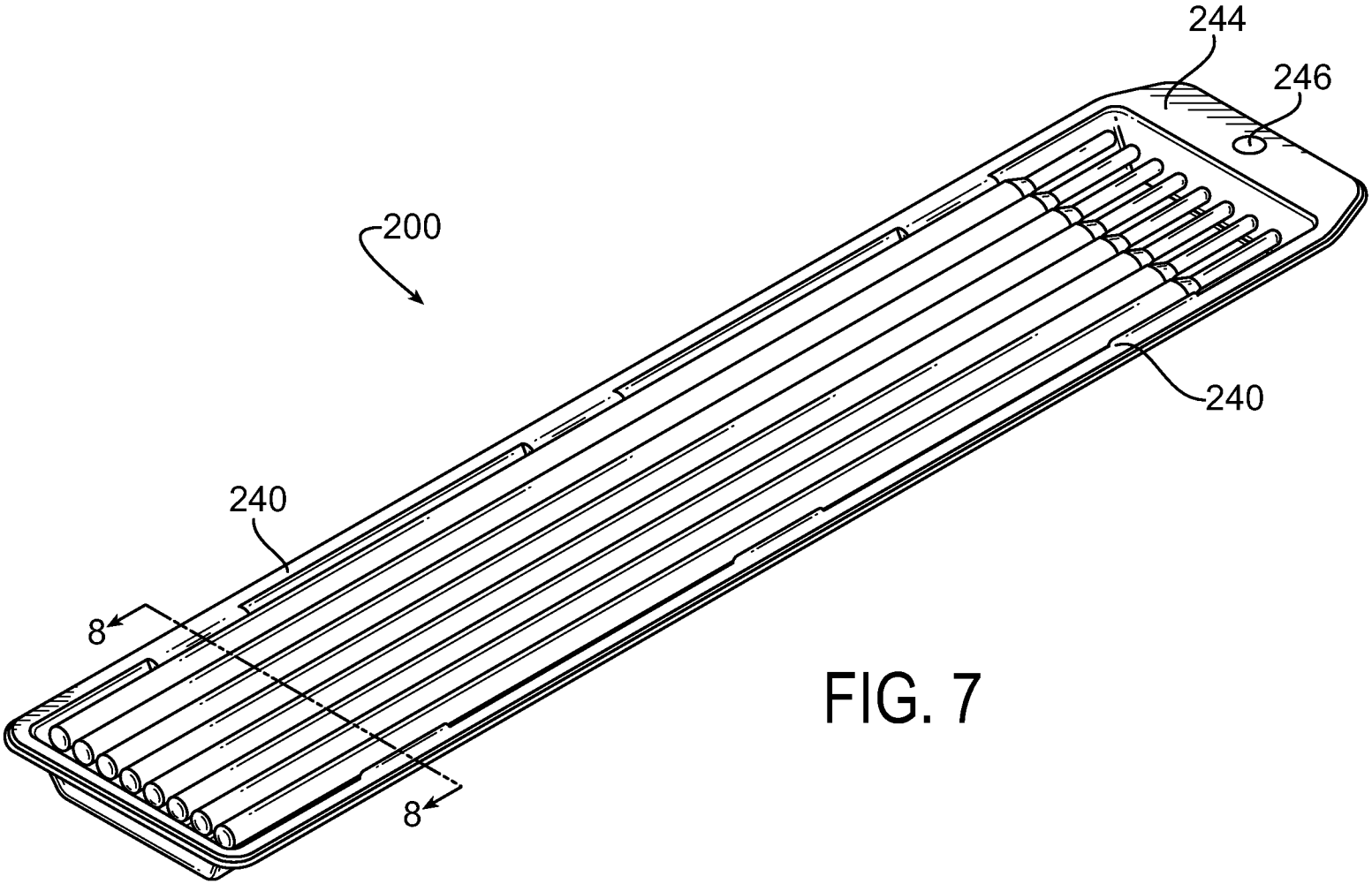
FIG. 7 is a perspective view of the container in FIG. 6 with associated elongated articles therein.

As compared to the embodiment in FIGS. 1-5, in the exemplary embodiment shown in FIGS. 6-9, a container 200 also includes at least one, preferably two or more first steps 230 which extend a height $H_1$ upward from the bottom wall 220, although the first steps 230 have different dimensions than first steps 130. The first steps 230 have a variable length which is equal to the width of the container bottom between one side wall 222 and angled wall 234. Given that the walls 222, 234 angle away from each other, it should be understood that the length of the first steps 230 varies from a relatively shorter length $L_1$ nearer the bottom of the container 200 to a relatively longer length $L_2$ nearer the flange 240, moving upward from the bottom wall 220 as the distance between the walls 222, 234 increases. As best shown in FIG. 6, the first steps 230 may be three steps. The first steps 230 may be spaced or arranged equidistantly along the length of the container 200, although other, asymmetrical arrangements of the steps are also contemplated. The distance between the spaced apart end walls 224 is substantially the same as the length of each of the elongated articles 250. In the embodiment best shown in FIG. 6, the at least one first steps 230 is three steps. The first steps 230 may be spaced or arranged equidistantly along the length of the container 200, although other, asymmetrical arrangements of the steps are also contemplated.

In addition to the first steps 230, the container also includes at least one, preferably two or more, second steps 232. The second steps 232 extend a height $H_2$ upward from the bottom wall 220. Unlike the first steps 230, the second steps 232 have a substantially fixed length $L_3$ which is distance between one of the side walls 222 and the second step angled wall 234 parallel to the side wall. That is, the length $L_2$ is approximately fixed, which is in contrast to the variable length of the first steps 230. In combination, then, the steps 230, 232 may be referred to as means for positioning the articles within the container 200. In one embodiment, at least one of each of the steps 230, 232 may extend directly from at least of the end walls 224. Although the steps 230, 232 are stamped or pressed into the container 200, it is also envisioned that an insert configured to have the same dimensions as the steps may be inserted into an unstamped container prior to filling with electrodes 250. In another embodiment, it is also envisioned that the container 200 may be molded from a plastic material.

Figure 8:
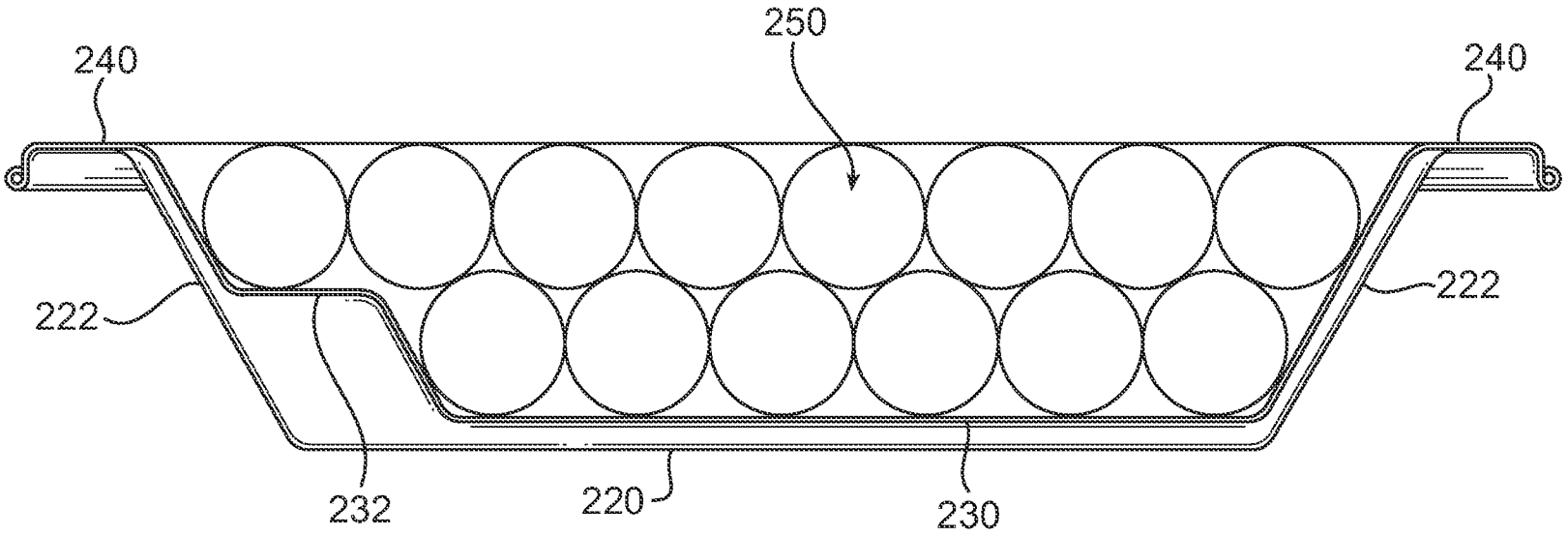
FIG. 8 is sectional view of the container and associated elongated articles shown in FIG. 7 taken along line 8-8.
Figure 9:
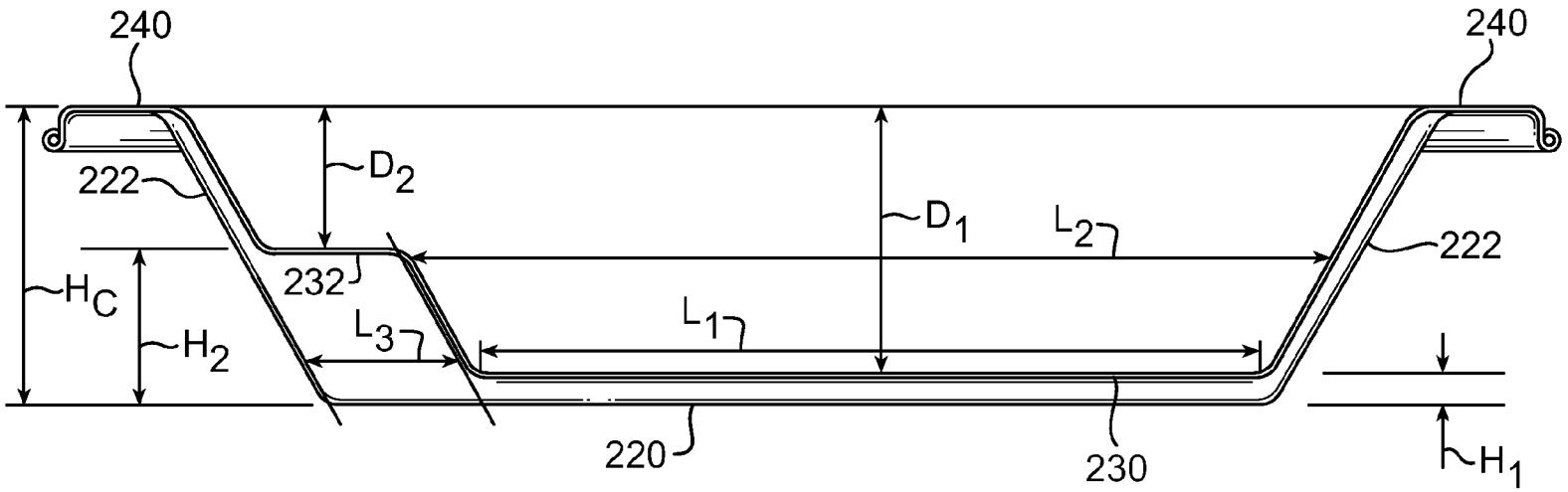
FIG. 9 is sectional view of the container in FIG. 6 taken along line 9-9.

As shown in FIGS. 8 and 9, the container cavity 210 has a first depth $D_1$, which corresponds to the height of the container $H_c$ minus the first step height $H_1$. Similarly, the container cavity 210 has a second depth $D_2$, which corresponds to the height of the container $H_c$ minus the height of the second step $H_2$. In the embodiment shown in FIGS. 6-9, the first depth $D_1$ is about 3.7 times the radius of one of the elongated articles 250, which corresponds to the height of three hexagonally packed rows of the elongated articles and results in the upper surface of the top row of elongated articles being flush or level with the flange 240. More specifically, the first depth $D_1$ is 3.73 times the radius of one of the elongated articles 250. Given the angled arrangement of the side walls 222, the height of the second step $H_2$ minus the height of the first step $H_1$ is less than twice the radius of one of the elongated articles. Similarly, the container cavity 210 has a second depth $D_2$, which corresponds to the height of the container $H_c$ minus the height of the second step $H_2$.

Figure 10:
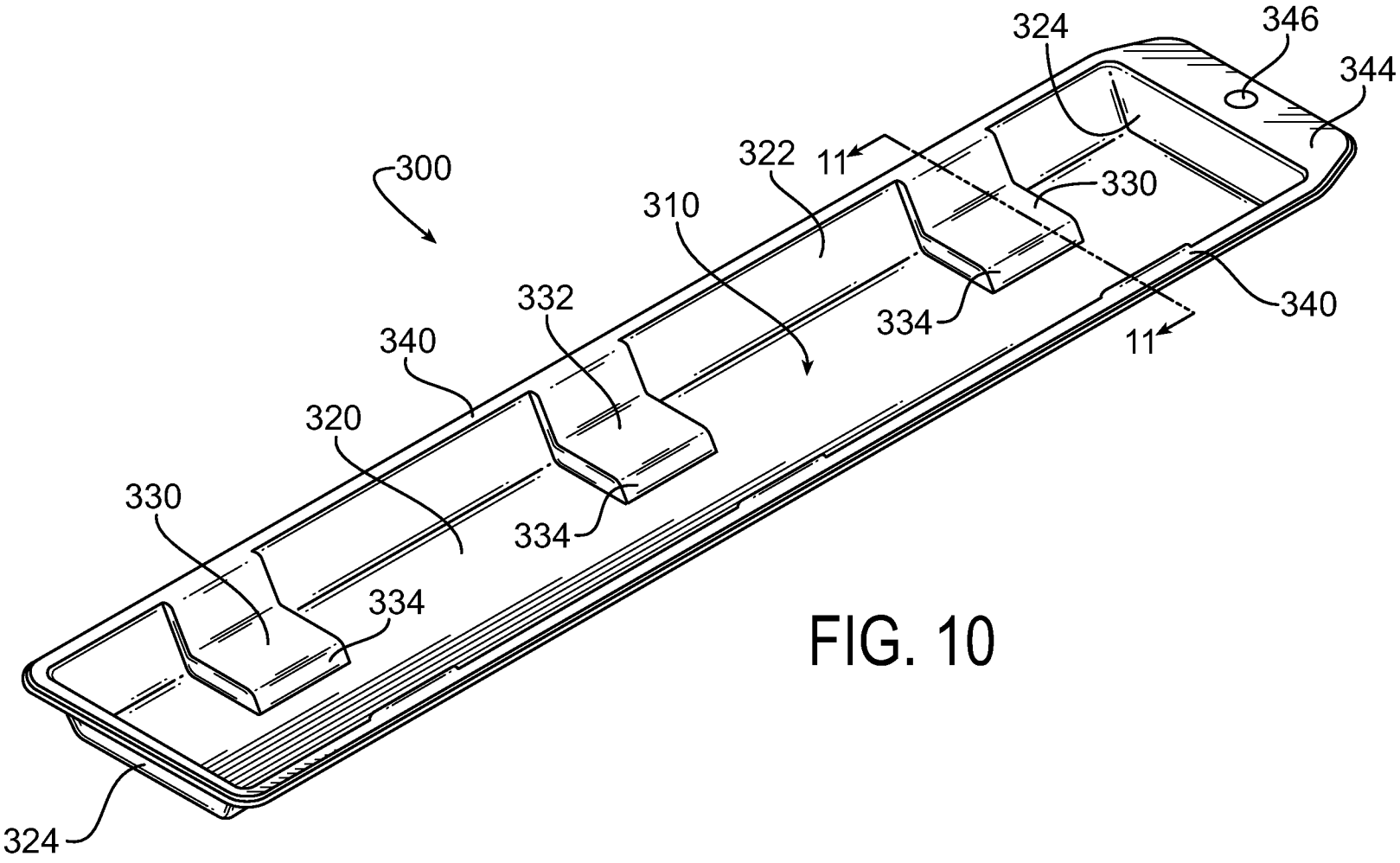
FIG. 10 is a perspective view of yet another embodiment of a container for elongated articles illustrating still another series of steps as compared to FIGS. 2 and 6.
Figure 11:
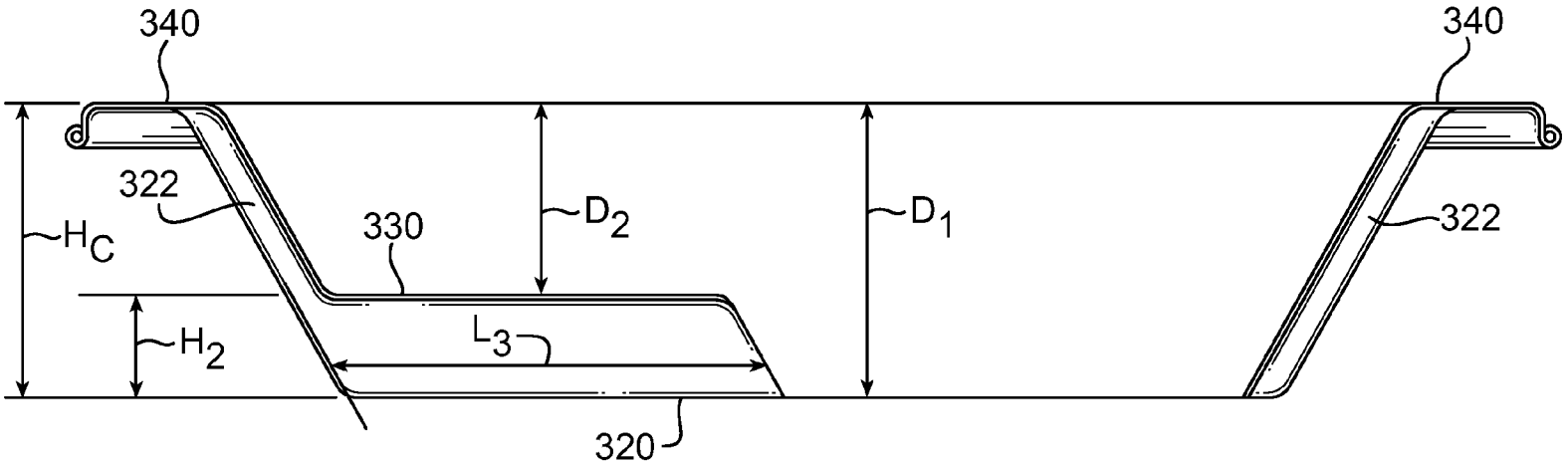
FIG. 11 is sectional view of the container in FIG. 10 taken along line 11-11.

In still another exemplary embodiment shown in FIGS. 10-11, a container 300 also includes at least one, preferably two or more, steps 330 which extend a height $H_2$ upward from the bottom wall 320. The steps 330 have a length $L_3$ which is less than the width of the container between the side walls 322. In addition, the steps 332 include a step angled wall 334 which is parallel to one of the side walls 322, which results in the length $L_3$ being substantially the same at each height of the steps 332. That is, the length $L_3$ is approximately fixed or constant. As best shown in FIG. 10, the at least one step 330 is three steps, and the steps 330 may be spaced or arranged equidistantly along the length of the container 300, although other, asymmetrical arrangements of the steps are also contemplated. The steps 330 may be referred to as means for positioning the articles within the container 300. Although the steps 330 are stamped or pressed into the container 300, it is also envisioned that an insert configured to have the same dimensions as the steps may be inserted into an unstamped container prior to filling with electrodes 350. In another embodiment, it is also envisioned that the container 300 may be molded from a plastic material.

As shown in FIG. 11, the container cavity 310 has a first depth $D_1$, which corresponds to the height of the container $H_c$. Similarly, the container cavity 310 has a second depth $D_2$, which corresponds to the height of the container $H_c$ minus the height of the step $H_2$. The steps 330 may be configured to have dimensions similar to those shown in FIG. 5 or 9, although other configurations may are contemplated depending on the specific electrode diameter-length-flux coating combination and the predetermined mass to be packaged within the container 300.

Figure 12:
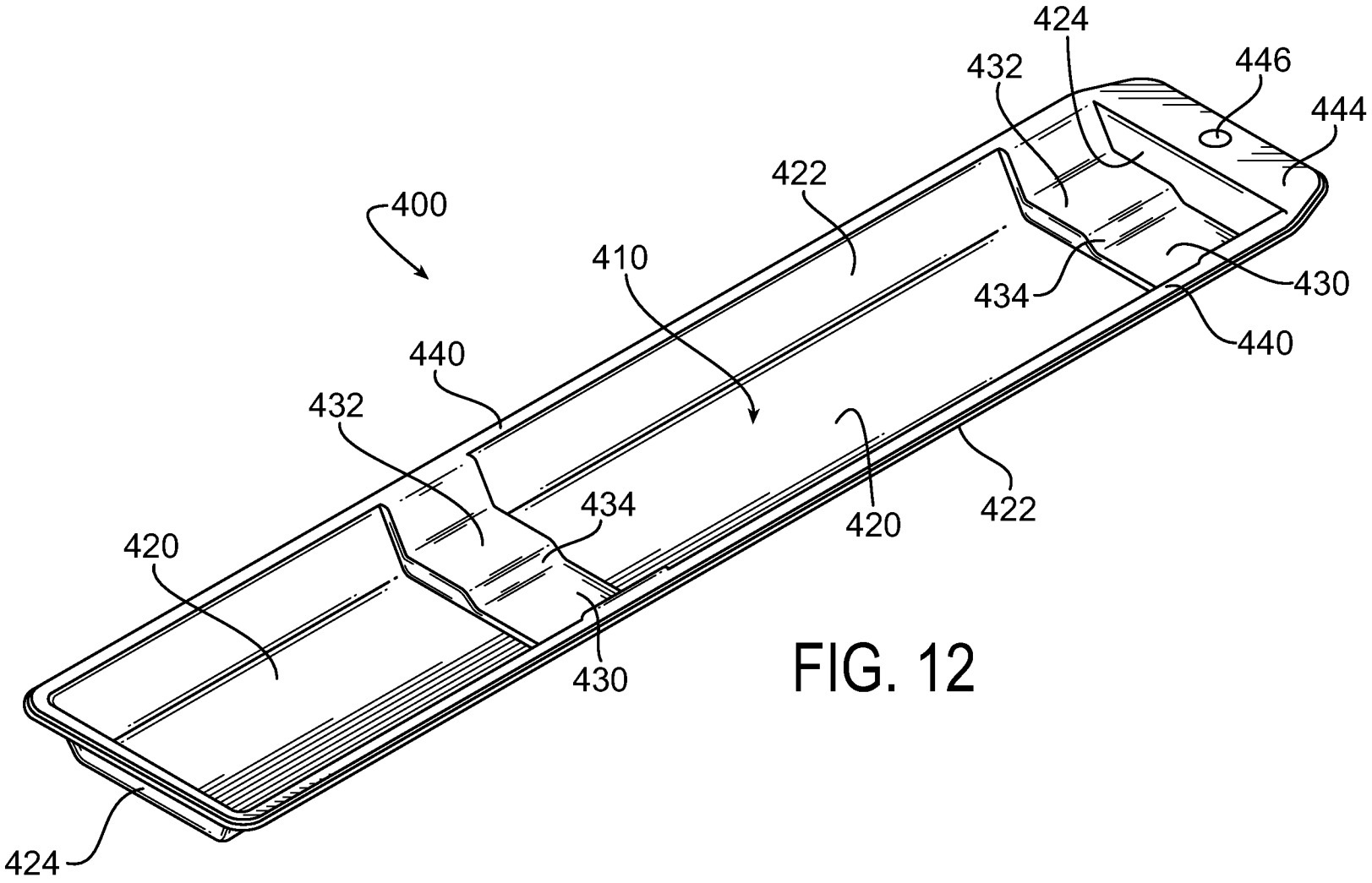
FIG. 12 is a perspective view of yet another embodiment of a container for elongated articles illustrating still yet another series of steps as compared to FIGS. 2, 6, and 10.

In still yet another exemplary embodiment shown in FIG. 12, a container 400 is configured in much the same manner as the container shown in FIGS. 1-5, with the at least one first steps 430 and the at least one second steps 432 having the same or similar dimensions as the steps 130, 132 shown in FIGS. 1-5. As compared to the embodiment in FIGS. 1-5, in the exemplary embodiment shown in FIG. 12, the container 400 also includes at least one, preferably two or more first steps 430 which extend a height upward from the bottom wall 420. The first steps 430 have a variable length which is equal to the width of the container bottom between one side wall 422 and angled wall 434. As best shown, the first steps 430 may be two steps. As shown, at least one of the first steps 430 is in contact with side wall 424. Nevertheless, the first steps 430 may be spaced or arranged equidistantly or asymmetrically along the length of the container 400.

As in the case of the embodiment of FIGS. 1-5, the second steps 432 of the embodiment in FIG. 12 extend a height upward from the bottom wall 420. In combination, then, the steps 430, 432 may be referred to as means for positioning the articles within the container 400. As shown, at least one of the steps 432 may extend directly from at least of the end walls 424. Although the steps 430, 432 are stamped or pressed into the container 400, it is also envisioned that an insert configured to have the same dimensions as the steps may be inserted into an unstamped container prior to filling with electrodes. In another embodiment, it is also envisioned that the container 400 may be molded from a plastic material.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. In combination, plural welding electrodes and a container for holding the plural welding electrodes; the container comprising:

a bottom wall having a perimeter;

at least one sidewall extending upward from the perimeter of the bottom wall to define a cavity having a first depth in which the plural welding electrodes are received in parallel arrangement at least one first step extending a first height upward from the bottom wall defining a second depth and having a length;

the first step extending across the cavity, wherein the length of the first step is less than a width of the bottom wall such that at least one of the plural welding electrodes rests on the first step and is raised above another of the plurality of the welding electrodes by the first height, wherein the length of the at least one first step laterally offsets the one of the plural welding electrodes relative to the second of the plural welding electrodes to form a hexagonal arrangement of the plural welding electrodes.

2. The combination as defined in claim 1, wherein the at least one sidewall is angled outwardly from the bottom wall at a preselected angle.

3. The combination as defined in claim 2, wherein the preselected angle is between about 55 and 65 degrees.

4. The combination as defined in claim 1 further comprising a second step extending from the first step across the cavity, wherein the height of the second step minus the height of the first step is less than twice a radius of one of the plural welding electrodes.

5. The combination as defined in claim 1, wherein the first depth of the container cavity is about 5.5 times a radius of one of the plural welding electrodes.

6. The combination as defined in claim 5, wherein the first depth of the container is 5.46 times the radius of one of the plural welding electrodes.

7. The combination as defined in claim 1, wherein the second depth of the container cavity is about 3.7 times a radius of one of the associated plural welding electrodes.

8. The combination as defined in claim 7, wherein the second depth of the container cavity is 3.73 times the radius of one of the associated plural welding electrodes.

9. The combination as defined in claim 1, wherein the distance between the spaced apart end walls is substantially the same as a length of each of the plural welding electrodes.

10. The combination as defined in claim 1, wherein a filled volume of the container is substantially equal to a predetermined mass of the plural welding electrodes divided by the product of about 0.9 times a bulk density of the plural welding electrodes.

11. The combination as defined in claim 1 further comprising a flange defining an upper perimeter of the container and extending from the an upper edge of the at least one sidewall.

12. The combination as defined in claim 11 further comprising a cover sealed to the flange.

13. The combination as defined in claim 12, wherein the cover is hermetically sealed to the flange.

14. The combination as defined in claim 1, wherein the at least one first step is formed integrally with the container.

15. The combination as defined in claim 1 further comprising a tab extending away from the container from one of the end walls.

16. In combination, plural welding electrodes and a container, the container comprising:

a bottom wall having a perimeter;

a pair of spaced apart side walls extending upwardly from perimeter of the bottom wall;

a pair of spaced apart end walls extending upwardly from the perimeter of the bottom wall between the sidewalls;

wherein said walls define a cavity that receives the plural welding electrodes in a parallel relationship to each other a plurality of longitudinally spaced apart steps between said pair of spaced apart end walls and each step extending a same height upward from the bottom wall and each step having a same length;

wherein the length is less than the width of the container between the sidewalls;

wherein one of the plural welding electrodes is supported on the pair of longitudinally spaced apart steps above another of the plural welding electrodes, wherein the length of the at least one first step laterally offsets the one of the plural welding electrodes relative to the second of the plural welding electrodes to form a hexagonal arrangement of the plural welding electrodes.

17. The combination as defined in claim 16, wherein the spaced apart sidewalls are angled outwardly from the bottom wall at an angle of about 55 to 65 degrees.

18. In combination, plural welding electrodes and a container for holding the plural welding electrodes, the container comprising: a bottom wall having a perimeter;

a pair of spaced apart side walls extending upwardly from perimeter of the bottom wall at an angle;

a pair of spaced apart end walls extending upwardly from the perimeter of the bottom wall between the sidewalls the walls defining a cavity that receives the plural welding electrodes in a parallel and adjacent relationship;

means for positioning one of the plural welding electrodes at a height above of the plural welding electrode within the container; and wherein the means for positioning has a length less than the width of the bottom wall, wherein the length laterally offsets the one of the plural welding electrodes relative to the second of the plural welding electrodes to form a hexagonal arrangement of the plural welding electrodes.

19. The combination as defined in claim 18, wherein the means for positioning are integral in the container.

20. The combination of claim 1, wherein the at least one sidewall includes a pair of parallel opposed longitudinal sidewalls extending outward relative to the bottom wall at a combined angle of about 60°.

* * * * *